US006439987B1

(12) United States Patent
Ripper et al.

(10) Patent No.: US 6,439,987 B1
(45) Date of Patent: Aug. 27, 2002

(54) TOOL AND METHOD FOR THE ABRASIVE MACHINING OF A SUBSTANTIALLY PLANAR SURFACE

(75) Inventors: Bert Ripper, Postbauer-Heng (DE); Hubert Grubmüller, Munderfing (AT)

(73) Assignee: Wacker-Siltronic Gesellschaft für Halbleitermaterialien AG, Burghausen (DE)

( * ) Notice: Subject to any disclaimer, the term of this patent is extended or adjusted under 35 U.S.C. 154(b) by 75 days.

(21) Appl. No.: 09/602,397

(22) Filed: Jun. 23, 2000

(30) Foreign Application Priority Data

Aug. 19, 1999 (DE) ..... 199 39 258

(51) Int. Cl.[7] ..... B24B 19/00; B24B 55/02

(52) U.S. Cl. ..... 451/443; 451/449; 451/529; 451/548

(58) Field of Search ..... 451/53, 443, 449, 451/450, 488, 527, 529, 533, 539, 548, 550

(56) References Cited

U.S. PATENT DOCUMENTS

| | | | | |
|---|---|---|---|---|
| 1,100,612 A | * | 6/1914 | Pointon | 451/529 |
| 4,471,579 A | | 9/1984 | Bovensiepen | |
| 4,918,872 A | | 4/1990 | Sato et al. | |
| 5,921,852 A | * | 7/1999 | Kimura et al. | 451/285 |
| 5,938,506 A | | 8/1999 | Fruitman et al. | |
| 6,019,666 A | * | 2/2000 | Roberts et al. | 451/36 |
| 6,019,672 A | * | 2/2000 | Damgaard | 451/527 |
| 6,062,958 A | * | 5/2000 | Wright et al. | 451/288 |
| 6,102,789 A | * | 8/2000 | Ramanath et al. | 451/28 |
| 6,110,027 A | * | 8/2000 | Muller | 451/342 |
| 6,129,609 A | * | 10/2000 | Ripper et al. | 451/21 |

FOREIGN PATENT DOCUMENTS

| | | |
|---|---|---|
| DE | 2026903 | 12/1971 |
| DE | 42 40 476 | 6/1994 |
| EP | 478 912 | 4/1992 |

OTHER PUBLICATIONS

English Derwent Abstract AN 1992–081046 [11] corresponding to EP 0 478 912.

English Derwent Abstract AN 1994–192976 [24] corresp. to DE 42 40 476.

* cited by examiner

*Primary Examiner*—Timothy V. Eley
(74) *Attorney, Agent, or Firm*—Collard & Roe, P.C.

(57) ABSTRACT

A tool and method are provided for the abrasive machining of a substantially planar surface. The tool has a base body and a plurality of elements which are mounted on the base body and form a planar coating which is used as a working coating during machining of the surface.

7 Claims, 3 Drawing Sheets

TOOL AND METHOD FOR THE ABRASIVE MACHINING OF A SUBSTANTIALLY PLANAR SURFACE

BACKGROUND OF THE INVENTION

1. Field of the Invention

The present invention relates to a tool and a method for the abrasive machining of a substantially planar surface.

2. The Prior Art

Tools of the generic type are, in particular, lapping wheels and grinding wheels which are required for the machining of disk-like workpieces, in particular of semiconductor wafers, and dressing rings which are used to level the working surfaces of lapping wheels and grinding wheels.

It is customary for such a tool to be made from a casting and to be prepared for use by machining and, if appropriate, local post-hardening. Particularly if the tool is required in connection with the production of semiconductor wafers, is has to satisfy stringent quality requirements. For example, fluctuations in terms of the hardness and structure of the crystal microstructure of the tool are to be kept within extremely narrow tolerance ranges. Particularly if this is a tool with a large working surface, this requirement can only be fulfilled with a considerable outlay in terms of machinery. The use of a tool with different local hardnesses and an inhomogenous microstructure is not acceptable, however, since it cannot uniformly machine workpieces.

SUMMARY OF THE INVENTION

It is an object of the present invention to provide a procedure for fulfilling the requirement in a simpler and more advantageous way.

The present invention relates to a tool for the abrasive machining of a substantially planar surface, which has a base body and a plurality of elements which are mounted on the base body. These elements form a planar coating which is used as the working coating during machining of the surface.

The present invention also relates to a method for the abrasive machining of a substantially planar surface using a tool, wherein a plurality of elements are mounted on a base body. The elements form a planar coating which is used as a working coating during machining of the surface.

The present invention has a number of particular advantages. For example, a smaller cast mass is required to cast one element and can be controlled more easily. Thus bodies with a more homogenous microstructure and hardness are obtained even during casting of the elements than would be the case in a single-piece cast body with the mass of a plurality of elements. Furthermore, a plurality of individual elements can be machined further more easily than one casting of the same mass. A particular advantage is that the individual elements can be examined in terms of their properties such as microstructure and hardness and can be selected for use in the tool. In this way, it is possible to obtain a tool whose properties, such as for example the microstructure and hardness, lie within a particularly narrow tolerance range and are accurately matched to the object which is to be achieved using the tool. An element which has not been selected, for example because its hardness was not within the required tolerance range, is stored. This storage continues until a tool is to be provided for a task whose execution requires a working coating whose properties correspond to those of this stored element in storage.

In contrast to the elements, the base body is scarcely subject to wear and can therefore be reused to a greater extent than the elements. It is preferable for a base body to be used only on a single machine. This avoids prolonged positioning times which are required during a tool change. Therefore, it is particularly preferable to provide two base bodies for one machine, which bodies are used alternately on this machine.

The elements are made from cast metal and only those elements which have a substantially uniform microstructure and hardness are mounted on the base body.

The tool according to the invention is preferably designed as a lapping wheel for lapping or a grinding wheel for grinding disk-like workpieces, such as semiconductor wafers, or as a dressing tool for the abrasive machining of such lapping and grinding wheels.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
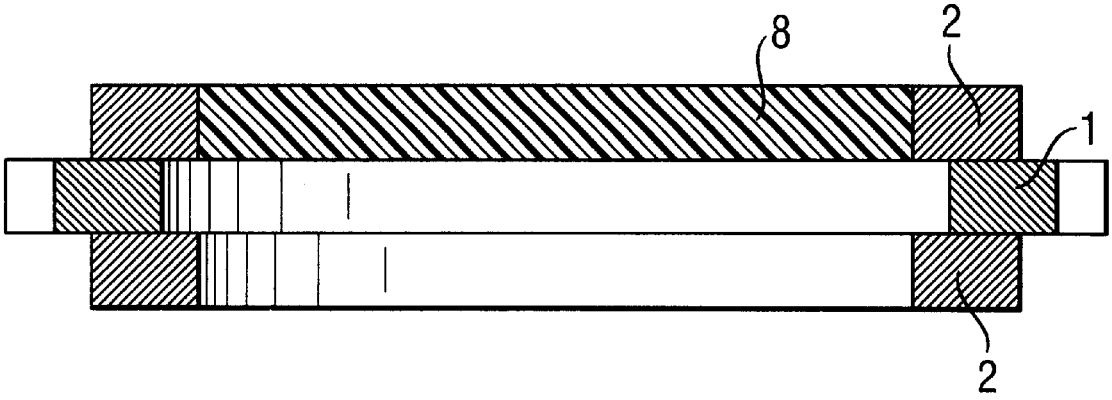
FIG. 1 shows a cross section through a dressing tool for the abrasive machining of two lapping or grinding wheels lying opposite one another.

Turning now in detail to the drawings, FIG. 1 shows the dressing tool which comprises an annular base body 1, on which elements 2 are mounted on both sides. On its outer circumference, the base body 1 has toothing, as is also customary for carriers for holding disk-like workpieces of lapping or grinding machines. To dress the lapping or grinding wheels of such machines, the base body 1 is fitted with elements 2. Instead of a carrier between the top and bottom lapping or grinding wheels of the lapping or grinding machine, it is fitted with means for causing it to rotate, and if appropriate with an abrasively acting lapping agent being supplied.

When a lapping agent is being supplied, it is advantageous to use a base body with a relatively great ring width or to use a base body which is constructed as a circular disk. This is desirable in order to prevent the lapping agent from running off downwardly in an uncontrolled manner. According to a preferred embodiment of the invention, the annular hole of the base body is closed by means of a plastic disk 8. The base body is subjected to considerably lower loads by the dressing operation, so that its service life considerably exceeds that of the elements. The elements are checked for wear at regular intervals and are exchanged after a predetermined level of wear has been reached.

Figure 2:
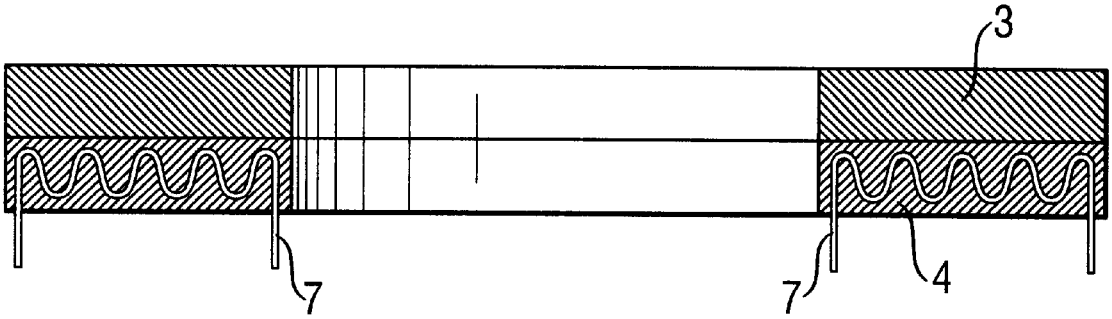
FIG. 2 shows a cross section through a tool which is useful as a lapping or grinding wheel.

The tool which is shown in FIG. 2 is constructed as a lapping or grinding tool. It comprises a base body 4, which is constructed as a circular disk, and has a plurality of elements 3 which are mounted on the base body on only one side. The base body has an active cooling system 7 which ensures effective dissipation of heat while the tool is in use.

When a multiplicity of elements are being used, the slotting of the coating which is customary in lapping wheels can be dispensed with. This saves one operation preparatory to use of the tool. The slotting of lapping wheels means forming elongated trench structures, which cross one another, in the working coating of the lapping wheel. This forms passages which can accommodate liquid from the lapping agent.

According to a preferred embodiment of the invention, gaps between the elements perform the function of such passages. When the elements are being mounted on the base body, they are placed in such a way that corresponding gaps are formed between the elements. It is particularly preferable for the shape of the elements and the gap width to be selected in such a way that the structure is similar to the surface of the coating of slotted lapping wheels.

Figure 3:
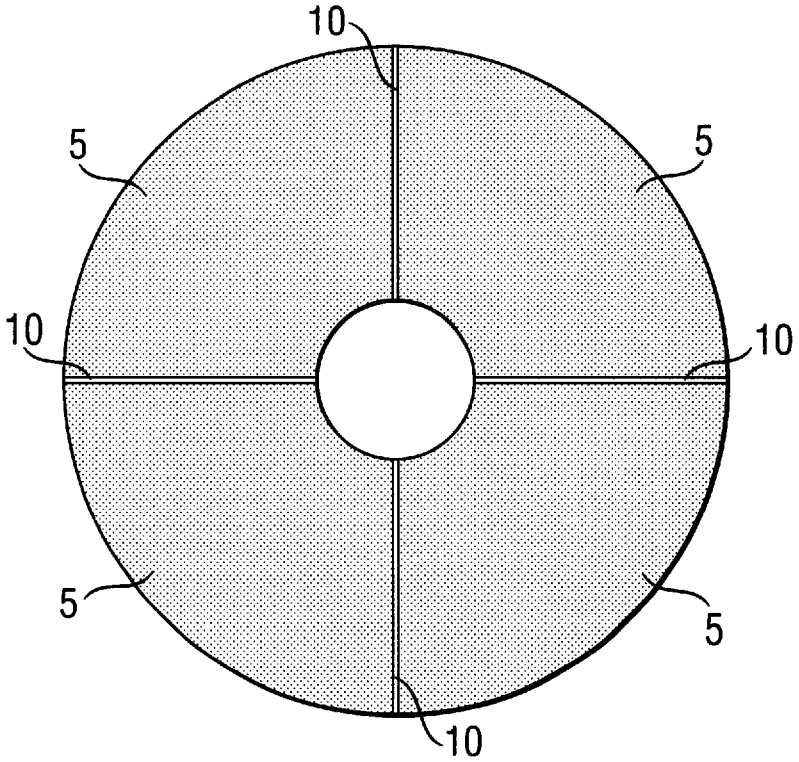
FIGS. 3 to 5 show plan views of elements which are preferably used.
Figure 4:
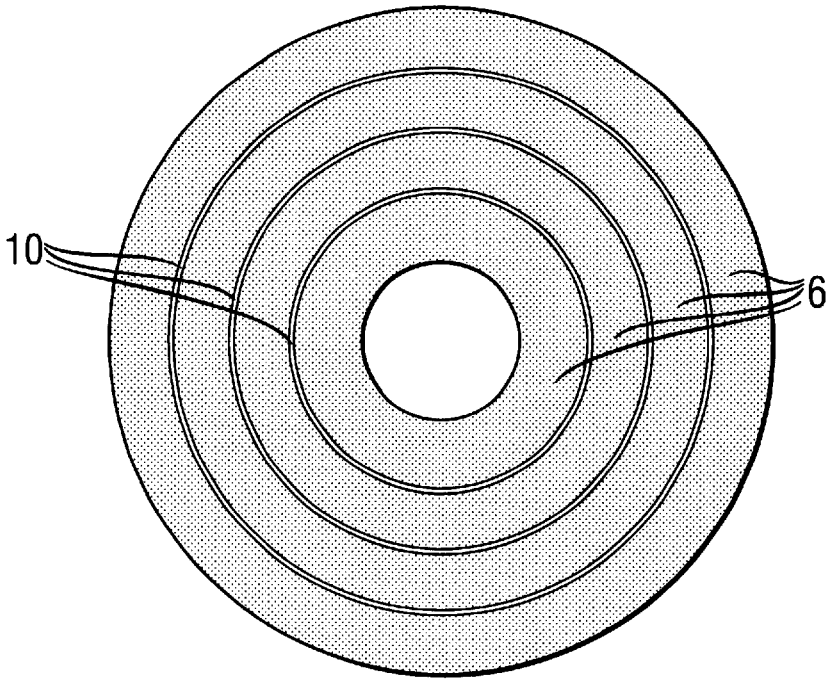
Figure 5:
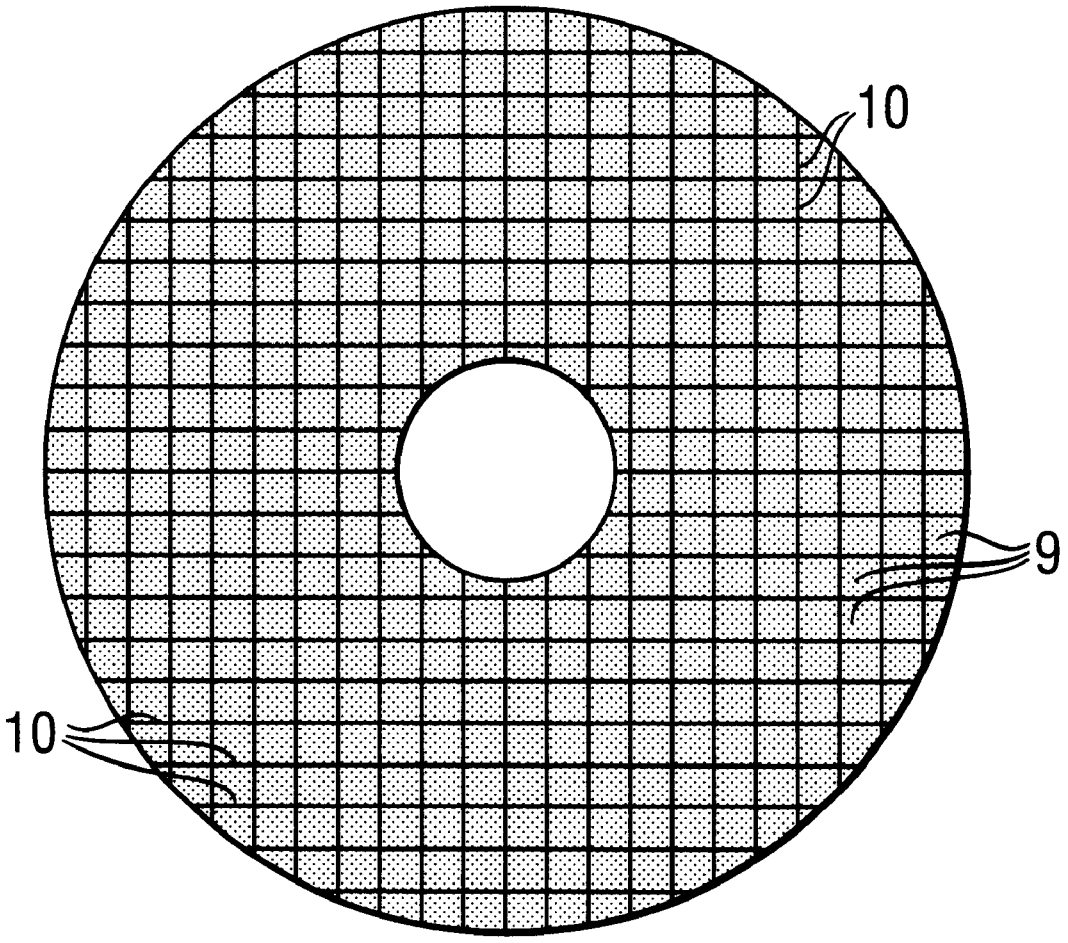

Preferred shapes and arrangements of the elements on the base body are shown in FIGS. 3, 4 and 5. FIG. 3 shows elements 5 which have the contour of circular-ring segments and are arranged next to one another in such a manner that they cover the annular base body. FIG. 4 shows annular elements 6 which, as concentric rings, cover the base body. FIG. 5 shows predominantly square elements 9 which substantially cover the surface of the base body. The elements 5, 6 and 9 are spaced apart from one another so that gaps 10 are formed. In regions in which the elements cover the edge of the base body, their corners are rounded accordingly. If a multiplicity of elements with a correspondingly small base surface area are mounted on the base body, it is possible to dispense with covering the base body with elements in the edge regions.

Accordingly, while a few embodiments of the present invention have been shown and described, it is to be understood that many changes and modifications may be made thereunto without departing from the spirit and scope of the invention as defined in the appended claims.

What is claimed is:

1. A tool for the abrasive machining of a substantially planar surface, which is used during semiconductor material production, comprising a base body; and a plurality of elements which are mounted on the base body and said elements form a planar coating on the base body; and said planar coating is used as a working coating during machining of the surface; and wherein the elements are produced by casting metal and only those elements which have a substantially uniform microstructure and hardness are mounted on the base body.

2. The tool as claimed in claim 1, wherein the base body is provided with an active cooling system.

3. The tool as claimed in claim 1, wherein the elements are shaped bodies having a contour which is selected from the group consisting of circular rings, circular-ring segments and regular polygons.

4. The tool as claimed in claim 1, wherein the tool is constructed as a lapping wheel for lapping disk shaped workpieces.

5. The tool as claimed in claim 1, wherein the tool is constructed as a grinding wheel for grinding disk shaped workpieces.

6. The tool as claimed in claim 1, wherein the tool is constructed as a dressing tool for the abrasive machining of a wheel selected from the group consisting of lapping wheels and grinding wheels.

7. A tool for the abrasive machining of a substantially planar surface comprising a base body; and wherein the base body is a circular ring and has an annular hole; and a plastic disk located in said annular hole to close said annular hole;

a plurality of elements which are mounted on the base body and said elements form a planar coating on the base body; and said planar coating is used as a working coating during machining of the surface.

* * * * *